US008605003B2

(12) United States Patent
Lai et al.

(10) Patent No.: US 8,605,003 B2
(45) Date of Patent: Dec. 10, 2013

(54) MINIATURE WIRE ANTENNA

(75) Inventors: Ming-Iu Lai, Taipei (TW); Chun-Hsiung Wang, Taipei (TW)

(73) Assignee: ASUSTeK Computer Inc., Taipei (TW)

( * ) Notice: Subject to any disclaimer, the term of this patent is extended or adjusted under 35 U.S.C. 154(b) by 873 days.

(21) Appl. No.: 12/725,750

(22) Filed: Mar. 17, 2010

(65) Prior Publication Data

US 2010/0271266 A1 Oct. 28, 2010

(30) Foreign Application Priority Data

Apr. 24, 2009 (TW) ..... 98113697 A

(51) Int. Cl.
*H01Q 1/36* (2006.01)
*H01Q 1/24* (2006.01)
*H01Q 1/38* (2006.01)

(52) U.S. Cl.
USPC ..... 343/895; 343/702; 343/700 MS

(58) Field of Classification Search
USPC ..... 343/700 MS, 895, 702, 725, 729, 846, 343/848
See application file for complete search history.

(56) References Cited

U.S. PATENT DOCUMENTS

| | | | | |
|---|---|---|---|---|
| 6,867,746 | B2 * | 3/2005 | Mendolia et al. | 343/841 |
| 6,992,633 | B2 * | 1/2006 | Kim et al. | 343/700 MS |
| 7,324,063 | B2 * | 1/2008 | Bae et al. | 343/895 |
| 7,362,285 | B2 | 4/2008 | Webb et al. | |
| 7,423,599 | B2 | 9/2008 | Li et al. | |
| 7,724,193 | B2 * | 5/2010 | Soora et al. | 343/700 MS |
| 7,999,758 | B2 * | 8/2011 | Bae et al. | 343/895 |
| 2008/0198073 | A1 | 8/2008 | Yeh | |

* cited by examiner

*Primary Examiner* — Michael C Wimer
*Assistant Examiner* — Hasan Islam
(74) *Attorney, Agent, or Firm* — Jianq Chyun IP Office

(57) ABSTRACT

A miniature wire antenna includes N rectangular metal plates located at a first layer of a PCB, a tunable metal plate located at the first layer of the PCB and N serpentine lines located at a second layer of the PCB. The positions of the N serpentine lines correspond to the positions of the rectangular metal plates. A first end of each of the serpentine lines is connected to the corresponding rectangular metal plate, and a second end of each of the serpentine lines is connected to the next rectangular metal plate. A first end of the last serpentine line is connected to the corresponding rectangular metal plate, and a second end of the last serpentine line is connected to the tunable metal plate.

8 Claims, 10 Drawing Sheets

MINIATURE WIRE ANTENNA

FIELD OF THE INVENTION

The invention relates to a wire antenna and, more particularly, to a miniature wire antenna.

BACKGROUND OF THE INVENTION

As everyone knows, functions related to a wireless local area network (WLAN), a global positioning system (GPS) or a global system for mobile communication (GSM) gradually become basic functions of a portable device. Thus, the portable device should have multiple built-in antennas to receive signals at different frequency bands. Since the size of the portable device is smaller and smaller, the size of the antenna is preferably smaller.

Generally, a chip antenna is the smallest antenna in size. To take a WLAN antenna as an example, the size of the chip antenna is less than 2 mm×5 mm×1 mm. However, the chip antenna is expensive, and its efficiency is not good.

There is another type of antenna which is a printed circuit board (PCB) antenna. The antenna is directly designed on the PCB. The PCB antenna has a low cost, but it occupies the largest area.

A wire antenna which is also called a monopole antenna may be designed on the PCB. The antenna includes a conducting line and a ground panel. The length of the conducting line is one quarter of the wavelength of the resonance frequency. Thus, the higher the resonance frequency is, the shorter the conducting line is. The lower the resonance frequency is, the longer the conducting line is. The conducting line is too long, and thus it is difficult to use the wire antenna in the mobile device directly.

To apply the wire antenna to the mobile device, generally the conducting line is designed to be winding type to reduce the area of the wire antenna. The winding conducting line may be a bent line or a serpentine line.

In addition, in pages 11 to 14 of the periodical, IEEE Antenna and wireless Propagation Letters 2007, a design of miniaturized printed wire antenna using double-layer periodic metallization is disclosed. In addition, in the periodical, IEEE APS 2008, a miniaturized printed wire antenna utilizing 3D substrate metallization for wireless communication is disclosed.

In the two periodicals, the wire antenna is designed utilizing the idea of an artificial transmission line. In the first periodical, a double-layer PCB is used, and the length of the WLAN antenna is reduced to about 12 millimeter (mm). In the second periodical, a three-layer PCB is used, and the length of the WLAN antenna is further reduced to about 8 mm. However, since the resonance frequency of both the two antennas cannot be tuned finely, the two antennas are hard to be used practically.

SUMMARY OF THE INVENTION

The invention discloses a miniature wire antenna which is different from the conventional miniature wire antenna in structures, and the resonance frequency of the miniature wire antenna also may be tuned finely.

The invention discloses a miniature wire antenna whose designing idea is from an artificial transmission line. The miniature wire antenna includes N rectangular metal plates located at a first layer of a PCB, a tunable metal plate located at the first layer of the PCB and N serpentine lines located at a second layer of the PCB. The positions of the N serpentine lines correspond to the positions of the rectangular metal plates. A first end of each of the serpentine lines is connected to the corresponding rectangular metal plate, and a second end of each of the serpentine lines is connected to the next rectangular metal plate. A first end of the last serpentine line is connected to the corresponding rectangular metal plate, and a second end of the last serpentine line is connected to the tunable metal plate.

These and other features, aspects and advantages of the present invention will become better understood with regard to the following description, appended claims, and accompanying drawings.

DETAILED DESCRIPTION OF THE PREFERRED EMBODIMENT

Figure 1B:
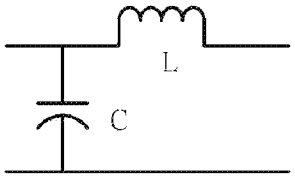
FIG. 1A and FIG. 1B are schematic diagrams showing a microstrip line and an equivalent circuit thereof.
Figure 1A:
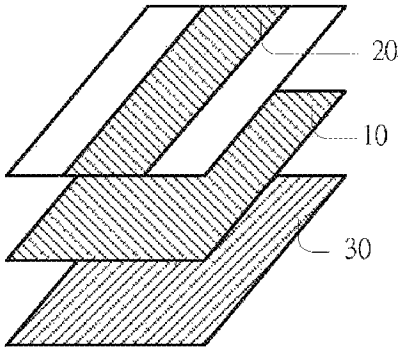

FIG. 1A and FIG. 1B are schematic diagrams showing a microstrip line and an equivalent circuit thereof. The microstrip line has a common guide-wave structure. The microstrip line includes a thin substrate 10, a conductor 20 and a ground panel 30. An equivalent circuit module of a small part of the microstrip line is shown in FIG. 1B, and it is an inductance-capacitance (LC) lumped-element. A characteristic impedance Z0, a wave number .beta. and a cutoff frequency fc are obtained as follows:

$$Z0 = \sqrt{\frac{L}{X}};$$

$$\beta = \omega\sqrt{LC};$$

$$fc = 1/\pi\sqrt{LC}.$$

When the ground panel 30 in FIG. 1A is removed, the configuration may be used to design a monopole antenna which is also called a wire antenna. Since the length of the wire is about one quarter of the wavelength of the working frequency, it is not commonly used.

Figure 1C:
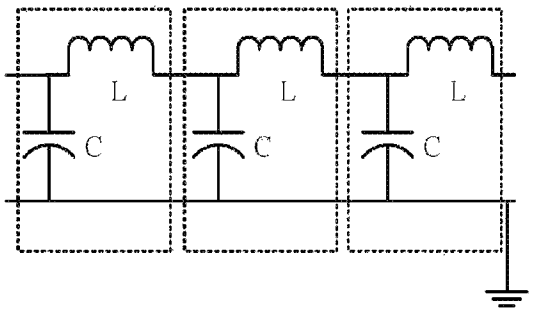
FIG. 1C is a schematic diagram showing an artificial transmission line.

FIG. 1C is a schematic diagram showing an artificial transmission line. That is, when multiple LC elements which are designed by oneself connected in cascade, an artificial transmission line is formed. If a ground layer in FIG. 1C is removed, a miniature wire antenna is formed. Since the value of the LC is larger than that of the conventional microstrip line, the length of the wire antenna is less than one quarter of the wavelength of the working frequency.

The wire antenna in the embodiment of the invention is formed by multiple rectangular metal plates and serpentine lines which are connected to each other. For example, a rectangular metal plate and a serpentine line are connected to each other to be formed on a two-layer PCB. That is, the rectangular metal plate may be disposed on the first layer of the PCB, and the serpentine line may be disposed on the second layer of the PCB. In addition, the rectangular metal plate and the serpentine line are electrically connected to each other through a via.

Figure 2:
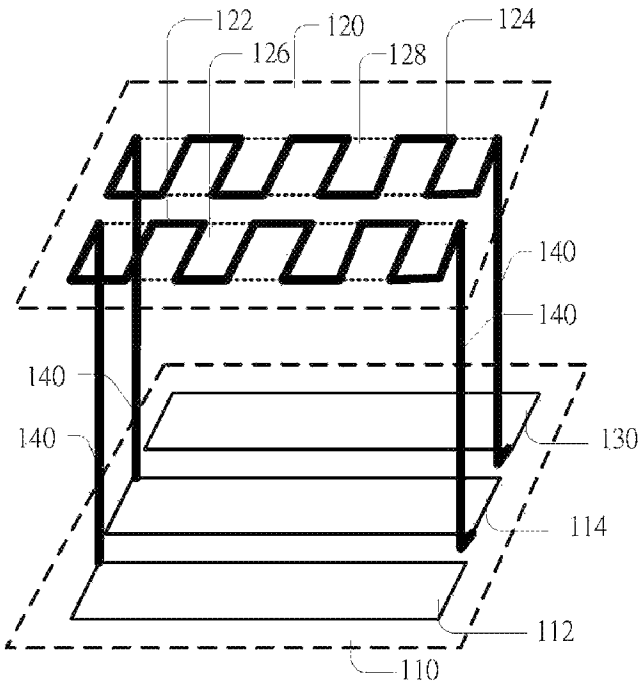
FIG. 2 is a schematic diagram showing a wire antenna in an embodiment of the invention.

FIG. 2 is a schematic diagram showing the wire antenna in an embodiment of the invention. When a ground panel is disposed below the first layer 110 of the PCB, the architecture may be considered as an artificial transmission line. The rectangular metal plates 112 and 114 may be equivalent to a capacitance element. The serpentine lines 122 and 124 may be equivalent to an inductance element. The wire antenna includes at least multiple rectangular metal plates 112 and 114, multiple serpentine lines 122 and 124, multiple vias 140 and a tunable metal plate 130. The rectangular metal plates 112 and 114 and the tunable metal plate 130 are located at the first layer 110 of the PCB, and the serpentine lines 122 and 124 are located at the second layer 120 of the PCB. The serpentine line 122 is located in the corresponding area 126 above the rectangular metal plate 112. The serpentine line 124 is located in the corresponding area 128 above the rectangular metal plate 114. In addition, one end of the serpentine line 122 is connected to the corresponding rectangular metal plate 112 through the via 140, and the other end of the serpentine line 122 is connected to the next rectangular metal plate 114 through the via 140. One end of the last serpentine line 124 is connected to the corresponding rectangular metal plate 114 through the via 140, and the other end of the last serpentine line 124 is connected to the tunable metal plate 130 through the via 140. Furthermore, the rectangular metal plates 112 and 114 and the tunable metal plate 130 are rectangular metal plates, and the designer may cut part of the tunable metal plate 130 to tune the resonance frequency of the wire antenna.

In FIG. 2, the wire antenna having two rectangular metal plates 112 and 114, two serpentine lines 122 and 124 and a tunable metal plate 130 is taken as an example. The number of the serpentine lines and the number of the rectangular metal plates are not limited. The following part illustrates embodiments in which the wire antenna in the invention is used at different frequencies.

Figure 3B:
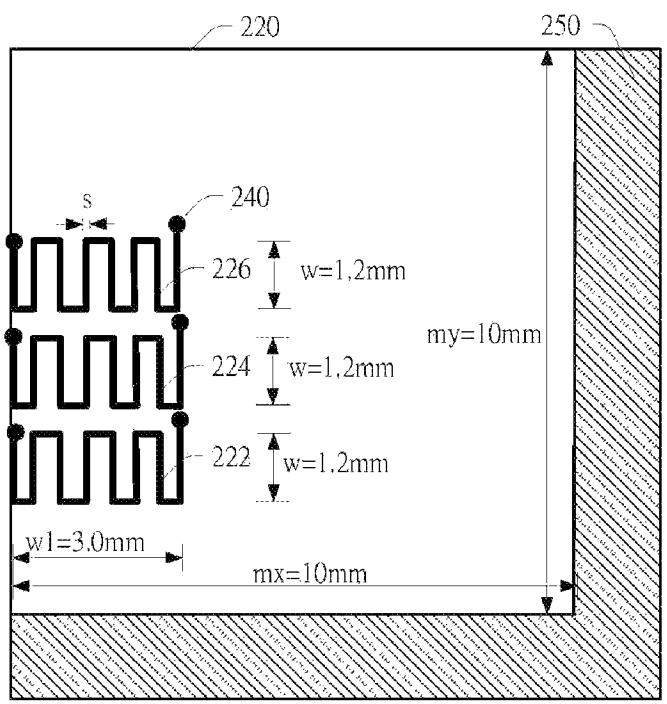
FIG. 3A to FIG. 3D are schematic diagrams showing a single band WLAN antenna in an embodiment of the invention.
Figure 3A:
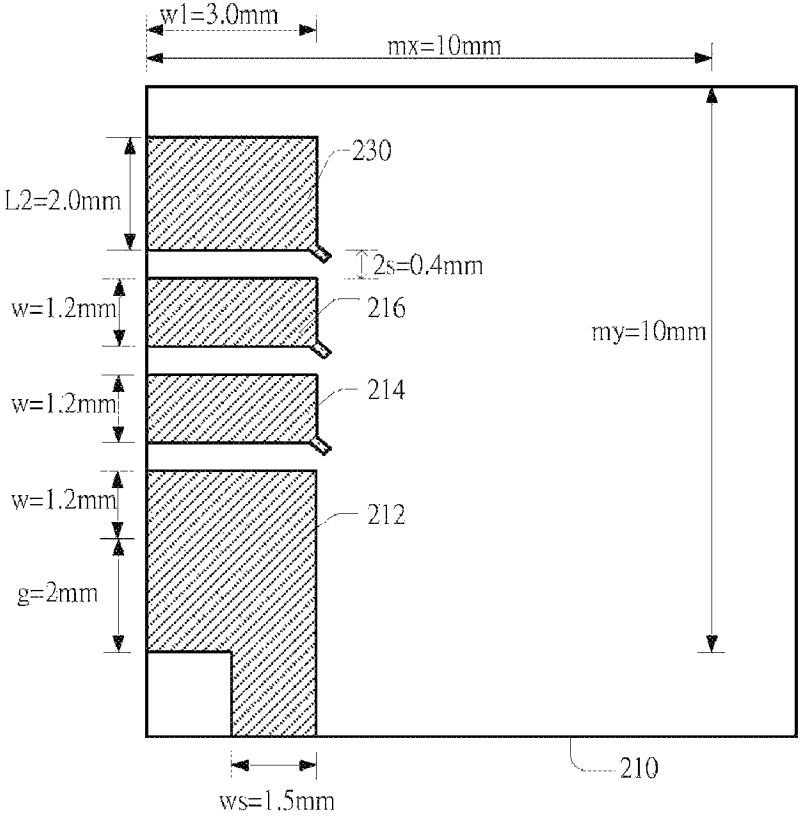

FIG. 3A to FIG. 3D are schematic diagrams showing the single band WLAN antenna in an embodiment of the invention. As shown in FIG. 3A, the first layer 210 of the PCB has three rectangular metal plates 212, 214 and 216 and a tunable metal plate 230 located at a metal free region whose size is mx×my=10 mm×10 mm. The widths (w1) of the rectangular metal plates 212, 214 and 216 are 3.0 mm, and the length (w+g) is 2.3 mm and the lengths (w) are 1.2 mm. The intervals (2*s*) are 0.4 mm. The width (w1) of the tunable metal plate 230 is 3.0 mm, and the length (L2) is 2.0 mm.

Figure 3C:
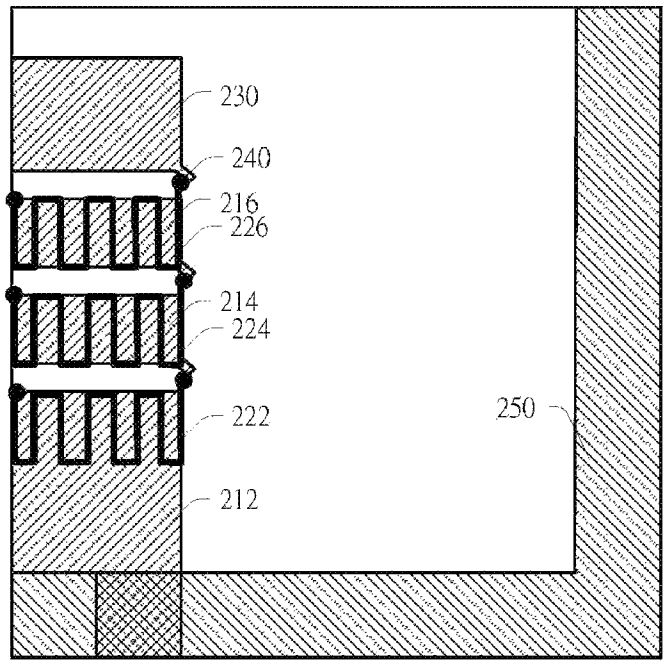

As shown in FIG. 3B, the second layer 220 of the PCB has three serpentine lines 222, 224 and 226 located in the metal free region whose size is mx×my=10 mm×10 mm, and the area outside the metal free region is the ground panel 250. In addition, the serpentine lines 222, 224 and 226 are located at the corresponding area above the rectangular metal plates 212, 214 and 216. Two ends of each of the serpentine lines 222, 224 and 226 have a via 240, respectively, to be connected to the corresponding rectangular metal plates 212, 214 and 216 or the tunable metal plate 230. In addition, the widths (s) of the serpentine lines 222, 224 and 226 are 0.2 mm. FIG. 3C is a schematic diagram showing the finished single band WLAN antenna.

Figure 3D:
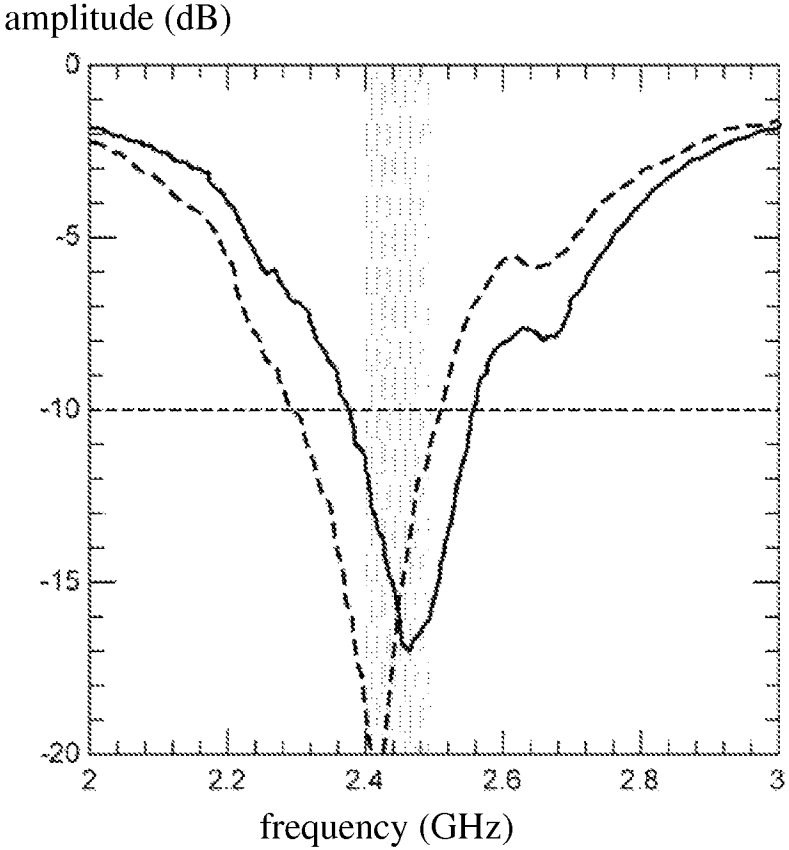

To make the wire antenna work at the right frequency, the designer may cut part of the tunable metal plate 230 to tune the frequency of the wire antenna. FIG. 3D is a schematic diagram showing the reflectance of the single band WLAN antenna. The dashed line represents the reflectance curve before the frequency is tuned. The solid line represents the reflectance curve after the frequency is tuned.

In addition, when the frequency that the single band WLAN antenna in FIG. 3C works at is 2.4 GHz, the efficiency is 74.8%; when the frequency is 2.45 GHz, the efficiency is 77.1%, and the antenna gain is 3.05 dBi; when the frequency is 2.5 GHz, the efficiency is 74.9%.

Figure 4B:
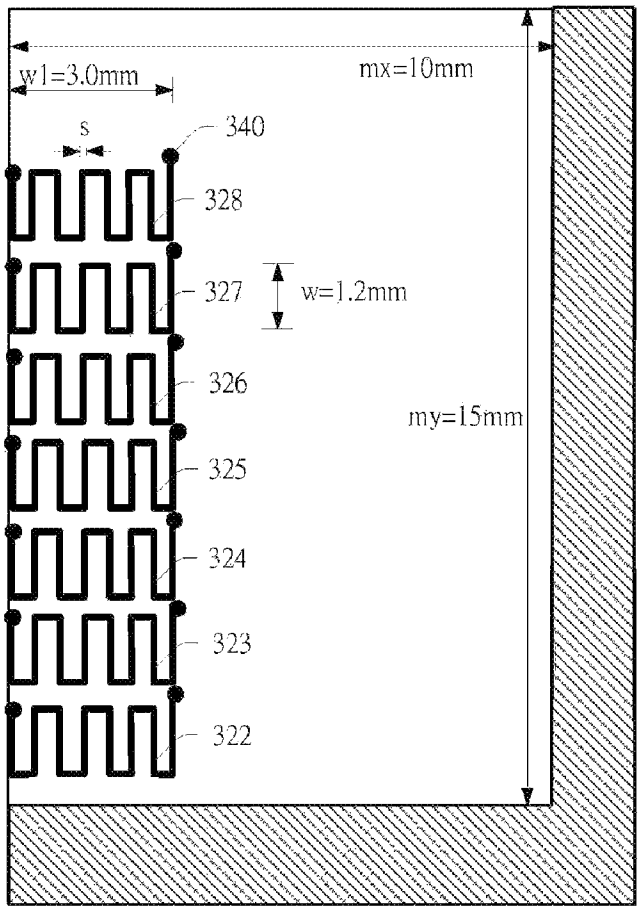
FIG. 4A to FIG. 4D are schematic diagrams showing a GPS antenna.
Figure 4A:
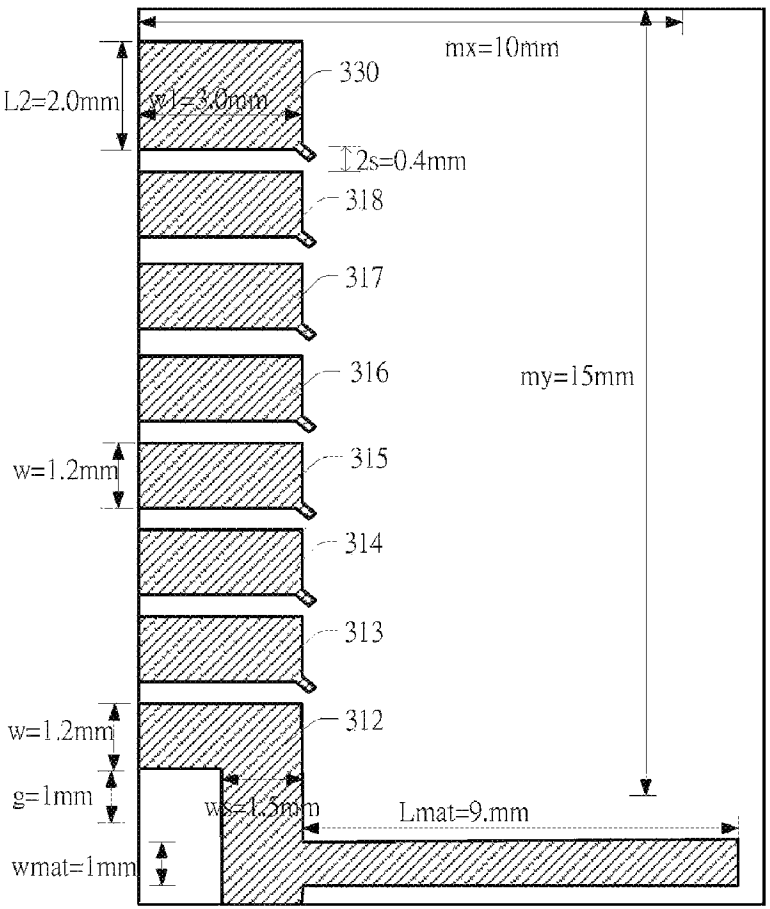

FIG. 4A to FIG. 4D are schematic diagrams showing the GPS antenna. As shown in FIG. 4A, the first layer of the PCB has seven rectangular metal plates 312, 313, 314, 315, 316, 317 and 318 and a tunable metal plate 330 located in the metal free region whose size is mx×my=10 mm×15 mm. The widths (w1) of the rectangular metal plates 312, 313, 314, 315, 316, 317 and 318 are 3.0 mm, the lengths (w) thereof are 1.2 mm, and the intervals (2*s*) are 0.4 mm. The width (w1) of the tunable metal plate 330 is 3.0 mm, and the length (L2) is 2.0 mm.

Figure 4D:
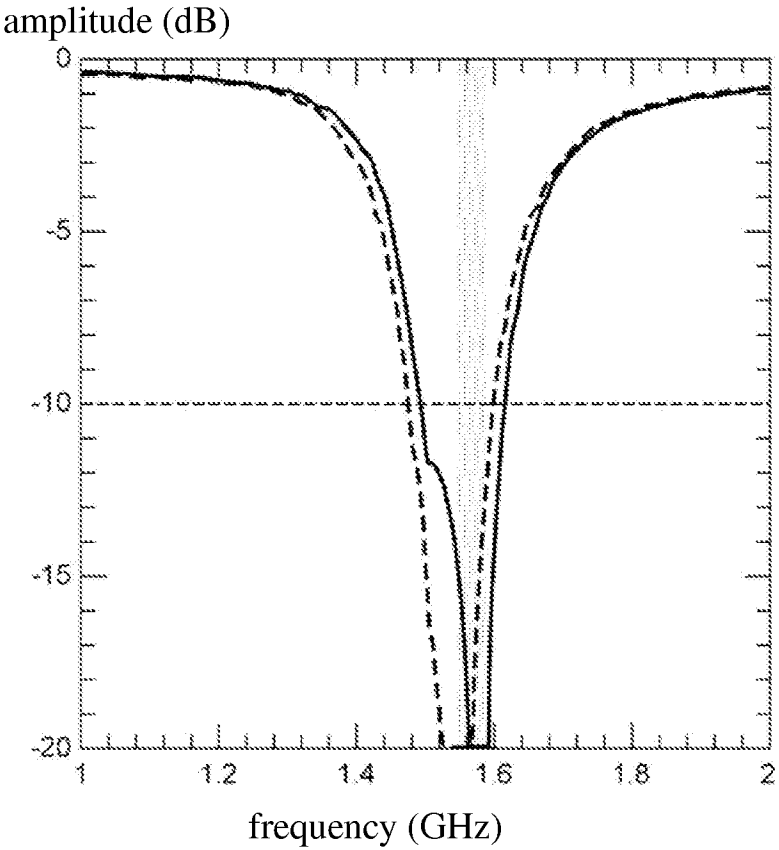
Figure 4C:
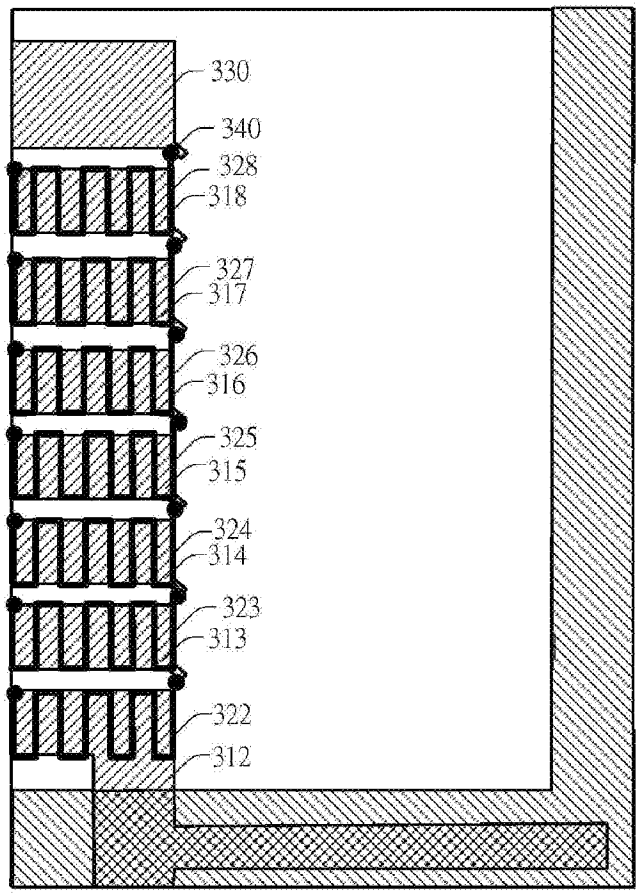

As shown in FIG. 4B, the second layer of the PCB has seven serpentine lines 322, 323, 324, 325, 326, 327 and 328 located in the metal free region whose size is mx×my=10 mm×15 mm. The area outside the metal free region is the ground panel. In addition, the serpentine lines 322, 323, 324, 325, 326, 327 and 328 are located in the corresponding area above the rectangular metal plates 312, 313, 314, 315, 316, 317 and 318. Two ends of each of the serpentine lines 322, 323, 324, 325, 326, 327 and 328 have a via 340, respectively, to be connected to the corresponding rectangular metal plates 312, 313, 314, 315, 316, 317 and 318 or the tunable metal plate 330. In addition, the widths of the serpentine lines 322, 323, 324, 325, 326, 327 and 328 are 0.2 mm. FIG. 4C is a schematic diagram showing the finished GPS antenna.

To make the wire antenna operable at the correct frequency, the designer may cut part of the tunable metal plate 330 to tune the frequency of the wire antenna. FIG. 4D is a schematic diagram showing the reflectance of the GPS antenna. The dashed line represents the reflectance curve before the frequency is tuned, and the solid line represents the reflectance curve after the frequency is tuned.

In FIG. 4C, when the GPS antenna works at the frequency 1570 MHz, the efficiency is 50.1%, and the antenna gain is 1.75 dBi.

Figure 5B:
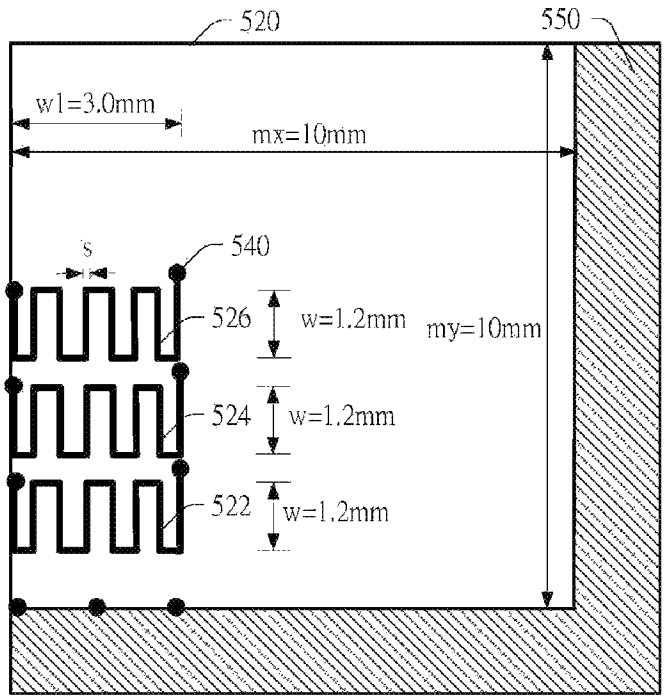
FIG. 5A to FIG. 5D are schematic diagrams showing a dual band WLAN antenna.
Figure 5A:
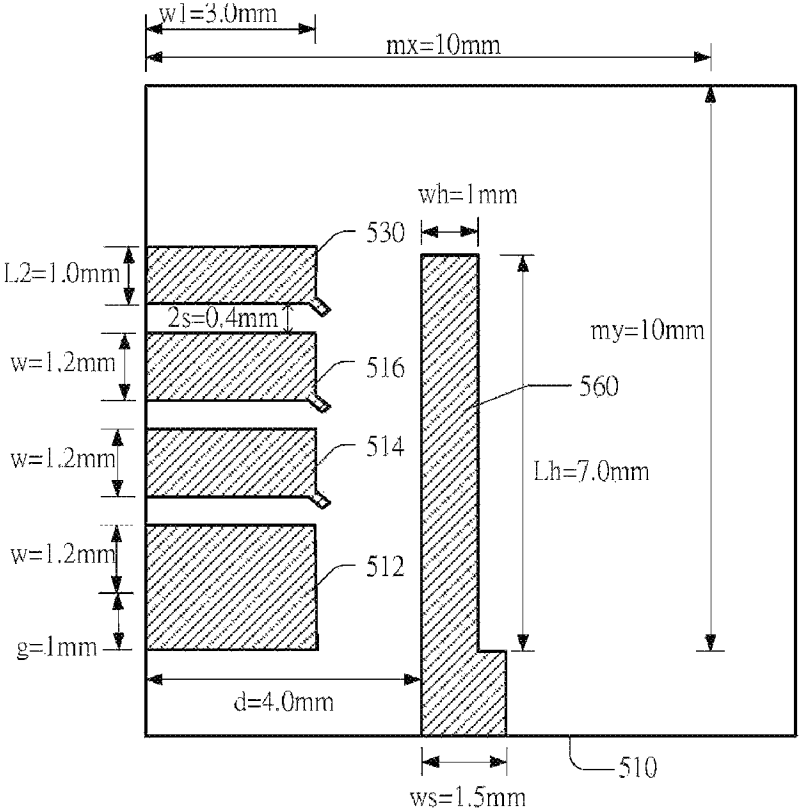

FIG. 5A to FIG. 5D are schematic diagrams showing a dual band WLAN antenna. As shown in FIG. 5A, the first layer 510 of the PCB has three rectangular metal plates 512, 514 and 516, a tunable metal plate 530 and a wide band wire antenna 560 located in a metal free region whose size is mx×my=10 mm×10 mm. The widths (w1) of the rectangular metal plates 512, 514 and 516 are 3.0 mm, the length (w+g) is 2.2 mm and the lengths (w) are 1.2 mm. The intervals (2*s*) are 0.4 mm. The width (w1) of the tunable metal plate 530 is 3.0 mm, and the length (L2) is 1.0 mm. In addition, the width (wh) of the wide band wire antenna 560 is 1.0 mm, and the length (Lh) is 7 mm.

Figure 5D:
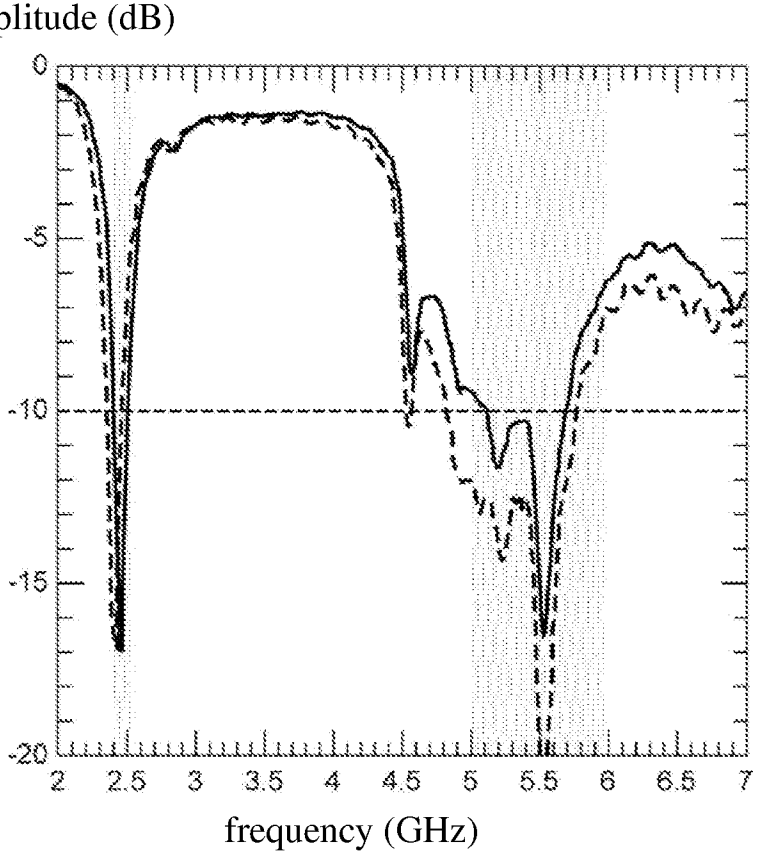
Figure 5C:
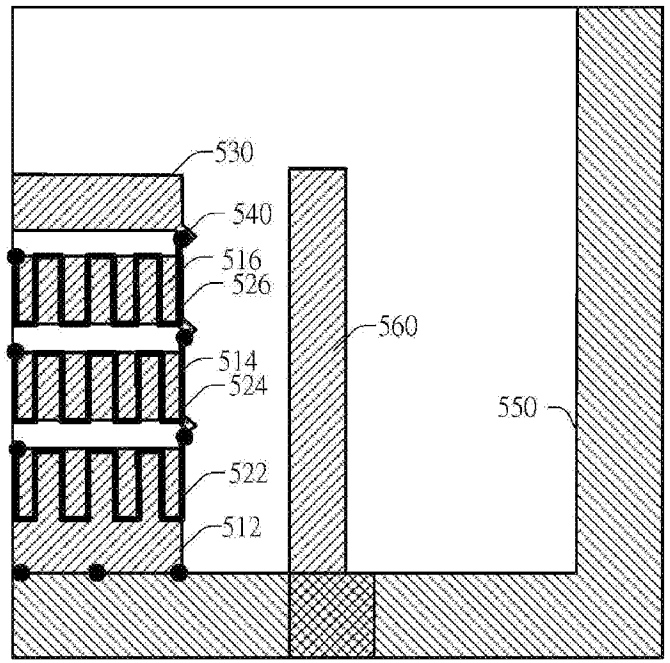

As shown in FIG. 5B, the second layer 520 of the PCB has three serpentine lines 522, 524 and 526 located in the metal free region whose size is mx×my=10 mm×10 mm. The area outside the metal free region is the ground panel 550. In addition, the serpentine lines 522, 524 and 526 are located in the corresponding area above the rectangular metal plates 512, 514 and 516. Two ends of each of the serpentine lines 522, 524 and 526 have a via, respectively, to be connected to the corresponding rectangular metal plates 512, 514 or 516 or the tunable metal plate 530. Furthermore, the widths (s) of the serpentine lines 522, 524 and 526 are 0.2 mm. FIG. 5C is a schematic diagram showing the finished dual band WLAN antenna.

To make the wire antenna operable at the correct frequency, the designer may cut part of the tunable metal plate 530 to tune the frequency of the wire antenna. FIG. 5D is a schematic diagram showing the reflectance of the dual band WLAN antenna. The dashed line represents the reflectance curve before the frequency is tuned, and the solid line represents the reflectance curve after the frequency is tuned.

In addition, the dual band WLAN antenna in FIG. 5C may work at the frequencies 2.5 GHz and 5.0 GHz. When the frequency is 2.45 GHz, the efficiency is 61.1%, and the antenna gain is 2.33 dBi. When the frequency is 5.0 GHz, the efficiency is 48.6%, and the antenna gain is −0.04 dBi. When the frequency is 5.4925 GHz, the efficiency is 28.8%, and the antenna gain is −1.59 dBi. When the frequency is 5.985 GHz, the efficiency is 45%, and the antenna gain is 0.15 dBi.

Figures 6A, 6B:
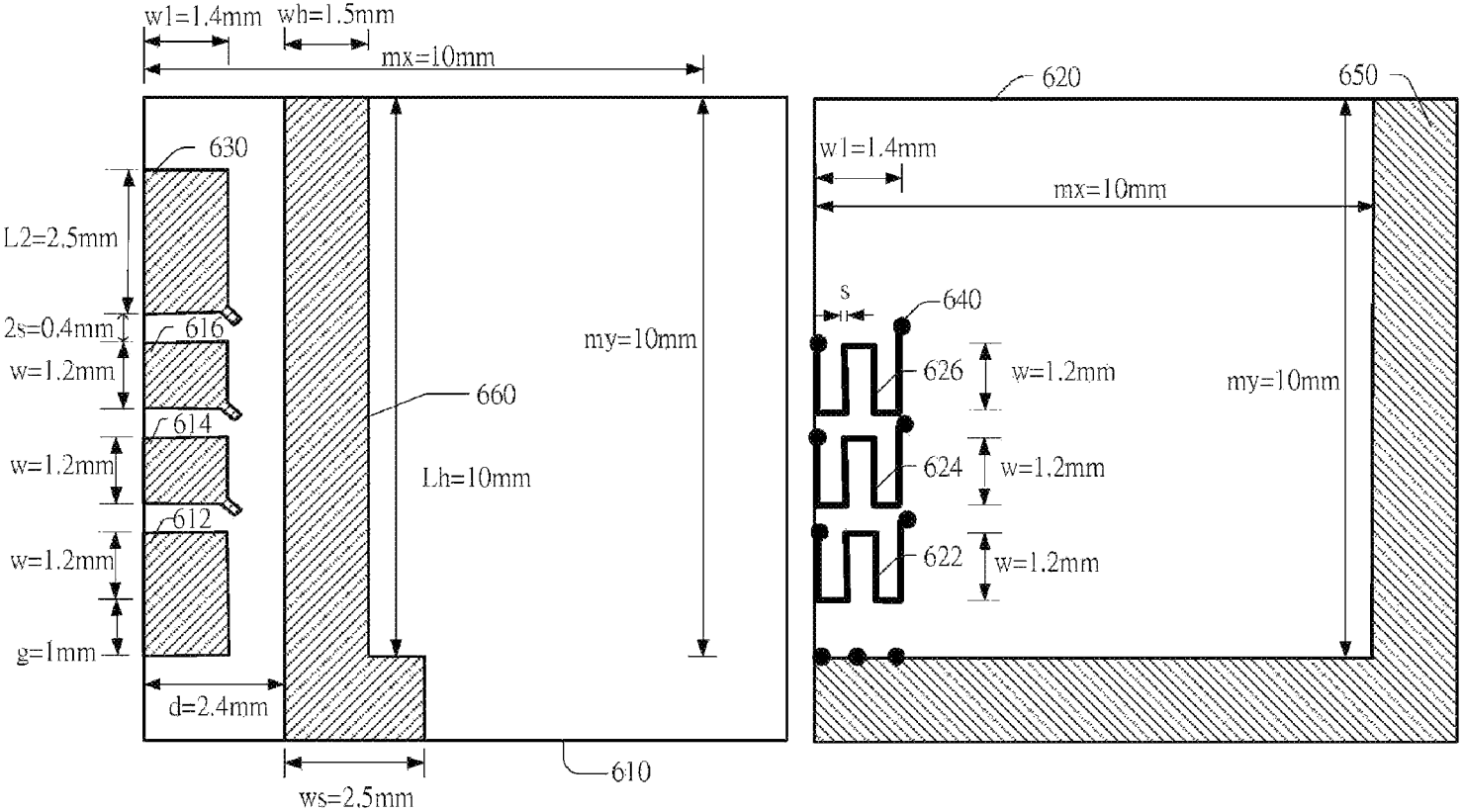
FIG. 6A to FIG. 6D are schematic diagrams showing an ultra wide band antenna.

FIG. 6A to FIG. 6D are schematic diagrams showing an ultra wide band antenna. As shown in FIG. 6A, the first layer 610 of the PCB has three rectangular metal plates 612, 614 and 616, a tunable metal plate 630 and a wide band wire antenna 660 located in a metal free region whose size is mx×my=10 mm×10 mm. The widths (w1) of the rectangular metal plate 612, 614 and 616 are 1.4 mm, and the length (w+g) is 2.2 mm and the lengths w are 1.2 mm, and the intervals (2*s*) are 0.4 mm. The width (w1) of the tunable metal plate 630 is 1.4 mm. The length (L2) is 2.5 mm. In addition, the width (wh) of the wide band wire antenna 660 is 1.5 mm, and the length (Lh) is 10 mm.

Figure 6D:
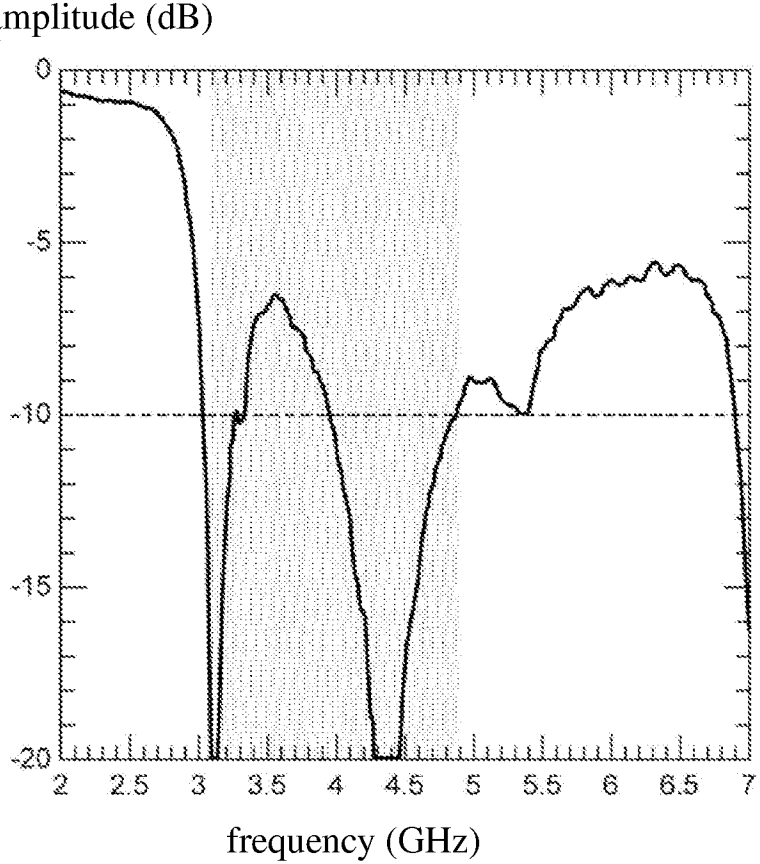
Figure 6C:
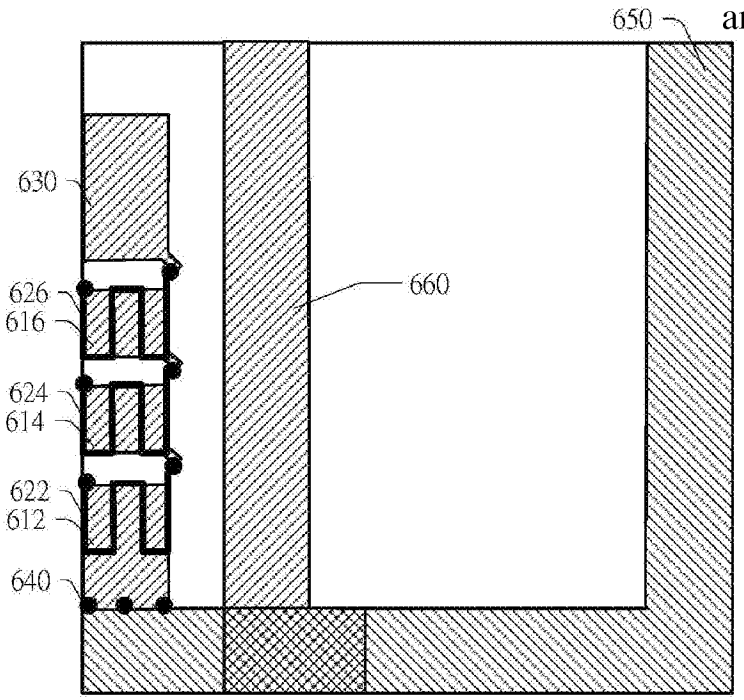

As shown in FIG. 6B, the second layer 620 of the PCB has three serpentine lines 622, 624 and 626 located in the metal free region whose size is mx×my=10 mm×10 mm. The area outside the metal free region is the ground panel 650. In addition, the serpentine lines 622, 624 and 626 are located in the corresponding area above the rectangular metal plates 612, 614 and 616. Two ends of each of the serpentine lines 622, 624 and 626 have a via 640, respectively, to be connected to the corresponding rectangular metal plates 612, 614, 616 or the tunable metal plate 630. In addition, the widths (s) of the serpentine lines 622, 624 and 626 are 0.2 mm. FIG. 6C is a schematic diagram showing the finished ultra wide band antenna. FIG. 6D is a schematic diagram showing the reflectance of the ultra wide band antenna.

In addition, the ultra wide band antenna in FIG. 6C may work at the frequency 3.0 GHz and the 4.0 GHz. When the frequency is 3.1 GHz, the efficiency is 62.2%, and the antenna gain is 2.33 dBi. When the frequency is 4.0 GHz, the efficiency is 52.2%, and the antenna gain is 1.83 dBi. When the frequency is 4.9 GHz, the efficiency is 40.9%, and the antenna gain is −0.17 dBi.

Thus, the invention discloses a miniature wire antenna, and the size of the antenna body is small. The resonance frequency of the miniature wire antenna may be tuned finely, and the miniature wire antenna is adapted to the portable device. In addition, as known from the four antenna embodiments, the size of the single band WLAN antenna body is substantially 3.0 mm×8.0 mm, the size of the GPS antenna body is substantially 3.0 mm×14.2 mm, the size of the dual band WLAN antenna body is substantially 5.0 mm×5.8 mm, and the size of the ultra wide band antenna body is substantially 4.9 mm×8.3 mm.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A miniature wire antenna comprising:

N rectangular metal plates located at a first layer of a PCB;

a tunable metal plate located at the first layer of the PCB; and

N serpentine lines located at a second layer of the PCB;

wherein N is an integer and greater than 1, positions of the N serpentine lines correspond to positions of the N rectangular metal plates, wherein each of the serpentine lines is substantially in full above a corresponding one of the rectangular metal plates except joining portions; a first end of each of the serpentine lines but a last one is connected to the corresponding one of the rectangular metal plates, and a second end of each of the serpentine lines but the last one is connected to a next one of the rectangular metal plates; a first end of the last one of the serpentine lines is connected to the corresponding one of the rectangular metal plates, and a second end of the last one of the serpentine lines is connected to the tunable metal plate.

2. The miniature wire antenna according to claim 1, wherein the tunable metal plate is a rectangular metal plate.

3. The miniature wire antenna according to claim 1, wherein part of the tunable metal plate is a miniature wire antenna.

4. The miniature wire antenna according to claim 1, wherein the miniature wire antenna is a single band wireless local area network (WLAN) antenna or a global positioning system (GPS) antenna.

5. The miniature wire antenna according to claim 4, wherein the miniature wire antenna is a dual band WLAN antenna or an ultra wide band antenna.

6. The miniature wire antenna according to claim 1, wherein the PCB further comprises multiple vias for connecting the rectangular metal plates and the serpentine lines.

7. The miniature wire antenna according to claim 1, wherein a region formed by a periphery of each of the serpentine lines is equal in shape to a region of the corresponding one of the rectangular metal plates.

8. The miniature wire antenna according to claim 1, wherein the last one of the serpentine lines is one of two end ones of the serpentine lines.

* * * * *